United States Patent [19]

Vydrin et al.

[11] 4,083,213

[45] Apr. 11, 1978

[54] DEVICE FOR AUTOMATIC ADJUSTMENT OF THE ROLL GAP IN A MILL STAND

[76] Inventors: Vladimir Nikolaevich Vydrin, ulitsa Timiryazeva, 28, kv. 27; Vladimir Georgievich Dukmasov, ulitsa Soni Krivoi, 77, kv. 5; Garifulla Davlyatshin, prospekt Komsomolsky, 15, kv. 100, all of Chelyabinsk, U.S.S.R.

[21] Appl. No.: 788,696

[22] Filed: Apr. 18, 1977

Related U.S. Application Data

[63] Continuation-in-part of Ser. No. 755,039, Dec. 28, 1976.

[51] Int. Cl.[2] ..... B21B 37/08

[52] U.S. Cl. ..... 72/6; 72/20; 72/245

[58] Field of Search ..... 72/6, 20, 19, 21, 245, 72/28

[56] References Cited

U.S. PATENT DOCUMENTS

| | | | |
|---|---|---|---|
| 3,427,839 | 2/1969 | Neumann | 72/20 |
| 3,686,907 | 8/1972 | Soholov et al. | 72/20 X |

*Primary Examiner*—Milton S. Mehr
*Attorney, Agent, or Firm*—Lackenbach, Lilling & Siegel

[57] ABSTRACT

A device for automatic adjustment of the roll gap in a mill stand has at least one load cell for each side of the stand. The load cells are mounted under chocks of at least one of the rolls and are adapted to absorb a rolling force. For prestressing the stand, the device is provided with hydraulic cylinders which are mounted so as to have no effect on the load cells. The device also incorporates three-chamber fluid (oil) pressure regulators, one for each load cell, communicating through a first end chamber thereof with chambers of the hydraulic cylinders at the respective side of the mill stand, through a midchamber thereof with the load cell chamber, and through a second end chamber with a constant-pressure fluid source. In addition, the device is fitted with regulated pressure valves, one for each load cell, said valves having throttle chambers communicating with a variable-pressure fluid source and with a mid-chamber of the three-chamber fluid pressure regulators, a control chamber of said valves being in communication with chambers of the load cells.

3 Claims, 3 Drawing Figures

DEVICE FOR AUTOMATIC ADJUSTMENT OF THE ROLL GAP IN A MILL STAND

CROSS REFERENCE TO RELATED APPLICATIONS

Figure 1:
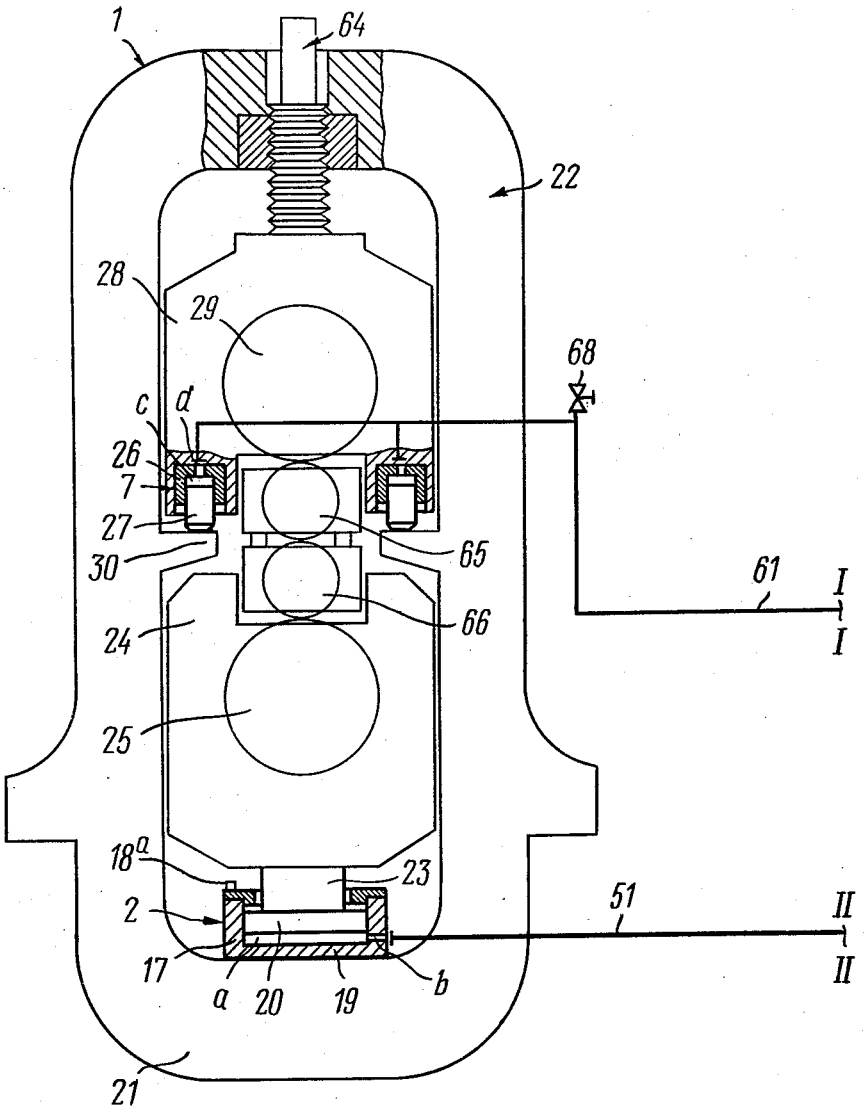

This application is a continuation-in-part application of U.S. patent application Ser. No. 755,039, filed on Dec. 28, 1976, for "DEVICE FOR AUTOMATIC ADJUSTMENT OF ROLL GAP IN MILL STAND".

BACKGROUND OF THE INVENTION

The present invention relates to rolling-mill equipment, and more particularly to a device for automatic adjustment of the roll gap in a mill stand.

The invention is best suited for adaptation in rolling mills for strips or sheets of metal.

There is known in the art a device for automatic adjustment of a roll gap in a mill stand, comprising one-chamber hydraulic cylinders adapted for prestressing the mill stand and mounted under the bottom roll chocks.

The hydraulic cylinders are provided with an electrohydraulic system to control the pressure of a fluid (oil) being fed into said hydraulic cylinders from a high-pressure fluid source.

The aforesaid eletrohydraulic system comprises electric load cells to absorb a rolling force, electric loads cells for registering a mill stand prestressing force and servovalves adapted to regulate the pressure of the fluid flow fed into the hydraulic cylinders for prestressing the mill stand, the servovalves having their own electric control circuit.

The electric load cells for absorbing the rolling force are installed under the stand housing screws and on the top roll chocks.

The electric load cells for registering the mill stand prestressing force are installed between a top-housing separator and the bottom roll chocks.

The servovalves together with their electric control circuit and the high-pressure fluid source are disposed outside the mill stand.

The afore described device for automatic adjustment of a roll gap in the mill stand operates as follows.

While rolling a metal strip, the rolling force changes and is then registered by said electric load cell.

The signal from this load cell is applied to the electrohydraulic system for fluid pressure control in the hydraulic cylinders.

As a result, the servovalve is operated to alter the fluid pressure in the hydraulic cylinder thereby altering the stand prestressing force.

It is, therefore, by way of effecting the prescribed alteration of the stand prestressing force in accordance with the rolling force that the automatic adjustment of the mill roll gap within the preset range is assured.

The aforesaid prior-art device allows for substantially accurate adjustment of a roll gap in the mill stand.

It is to be understood, however, that the servovalves require a highly purified fluid (oil), and, should it be otherwise, they become unstable in operation and the device looses its operating dependability.

In addition, the servovalves are rather complex in design, expensive to manufacture and difficult to operate. The servovalves, as well as their electric control system, require attendance of highly qualified personnel.

Inventor's Certificate of the USSR No. 452380 teaches a device for automatic adjustment of a roll gap in a mill stand, comprising at least one hydraulic load cell at both sides of the mill stand intended for absorbing a rolling force and mounted under the chocks of one of the rolls.

To develop a stand prestressing force, the device is provided with hydraulic cylinders mounted separately on both sides of the stand so as to have no effect on the load cells.

To regulate the fluid (oil) pressure in the hydraulic cylinders, the device is provided with three-chamber fluid pressure regulators, one for each load cell, communicating through the first end chamber thereof with chambers of the hydraulic cylinders at the respective side of the mill stand. Said fluid pressure regulator communicates through its midchamber with the load cell chamber by way of a shutoff valve, and through its second end chamber the regulator communicates with a constant-pressure fluid source.

The aforesaid prior-art device functions in the following manner.

During the rolling operation, as a metal strip passes between the rolls, the fluid pressure in the load cells varies with the rolling force.

Accordingly, the fluid pressure changes in the mid-chambers of the three-chamber pressure regulators thereby resulting in a shift of the valve spools of the pressure regulators.

The shifting of the valve spools causes the fluid pressure in the hydraulic cylinders to change, which results in the change of the stand prestressing force.

The device parameters are preselected so as to provide for the automatic adjustment of the mill roll gap by varying the stand prestressing force in accordance with the rolling force in a predetermined range. As to the control range, it is determined by way of adjusting the shutoff valve in accordance with a fluid pressure in the constant-pressure fluid source.

However, during the valve spool displacement in the three-chamber pressure regulators, there occurs an overflow of fluid from the load cell chamber into the mid-chamber of the three-chamber pressure regulator, which results in the displacement of the roll chocks thereby adversely affecting the accuracy of the roll gap adjustment.

Accordingly, it is an object of the present invention to provide a device for automatic adjustment of a roll gap in a mill stand, which will be simple in construction, reliable in operation and inexpensive to manufacture.

Another object of the invention is to provide a device for automatic adjustment of a roll gap in a mill stand, which will enable the use of a fluid (oil) with a purity degree characteristic of that employed in conventional hydraulic drives.

Still another object of the invention is to provide a device for automatic adjustment of a roll gap in a mill stand, which can be readily serviced by attendants of ordinary skill.

These and other objects and features of the invention are accomplished by the provision of a device for antomatic adjustment of a roll gap in a mill stand comprising two similar parts operating on an identical principle and arranged on each side of the mill stand, said operable parts each incorporating at least a one-chamber load cell mounted under a support member of one of the working rolls and adapted to absorb a rolling force; hydraulic cylinders mounted between a backup member of another working roll and a roll housing so as to have no effect on the load cell, said cylinders being intended for prestressing the mill stand, a three-chamber fluid pressure regulator communicating through its first end chamber with chambers of the hydraulic cylinders, through its mid-chamber with the load cell chamber, and through its second end chamber with a constant-pressure fluid source arranged outside the mill stand, said source being at least one of two operable parts of the device. In accordance with the invention, the device is provided with regulated pressure valves, one for each load cell, a throttle chamber of said pressure valves communicating with an alternating-pressure fluid source, one for each operable part of the device, and arranged on two sides of the mill stand, and with a mid-chamber of the three-chamber fluid pressure regulators, a control chamber of said valves communicates with chambers of the load cells.

In the device of the invention a change in the rolling force results in a change of the fluid pressure in the load cell and at the same time in the hydraulic cylinder chamber being in direct communication therewith.

As a result of this change, a valve spool of the regulated fluid pressure valve is shifted thereby to alter the direction of the fluid flow now passing through the throttle chamber of the regulated pressure valve, while a pump, being in direct communication with said chamber, now pumps the fluid into the mid-chamber of the three-chamber pressure regulator.

The valve spool of the three-chamber fluid pressure regulator is shifted thereby to alter the fluid pressure in the hydraulic cylinders for prestressing the stand, said cylinders being also in communication through chambers thereof with the first end chamber of the pressure regulator.

This brings about a change in the stand prestressing force and, consequently, a change in the roll gap.

Thus, it is through a proper selection of parameters for the hydraulic cylinders the load cells, the regulated pressure valve and the three-chamber pressure regulator, that there is attained, like in the prior-art devices, a prescribed variation in the stand prestressing force depending on the change in the rolling force, thereby enabling automatic roll gap adjustment.

Furthermore, there comes into play the rolling force produced during the rolling operation, which causes fluid to pass from the load cell into the control chamber of the regulated pressure valve with a spool thereof being of far less diameter than that of the load cell piston rod. The spool traverse being rather limited, the fluid from the load cell is prevented from flowing into the mid-chamber of the three-chamber pressure regulator thereby rendering immobile the roll chock resting upon the load cell piston rod.

It is expedient that the regulated pressure valve be combined with the three-chamber pressure regulator so that the midchamber of the regulator will serve as a control chamber of the regulated pressure valve, and the first end chamber of the pressure regulator will serve as a throttle chamber of the regulated pressure valve. This will substantially simplify the design of the proposed device.

During the rolling operation, the fluid is fed to the hydraulic cylinders for prestressing the mill stand directly from the constant-pressure fluid source. Such delivery of fluid precludes the use of a number of units and lines in the device of the invention, and makes it simpler and more reliable in operation.

It is also advisable that the proposed device be provided with means for varying the amount of fluid in a closed chamber formed during the rolling operation by the first end chamber of the pressure regulator and by the chambers of the hydraulic cylinders at the respective stand side, said means being made as a hydraulic cylinder fitted with a screw rod and having its working chamber in communication with the closed chamber.

The aforesaid means are designed to allow parameter correction to be effected in the proposed device with the stand rigidity being varied, whereby said device is rendered easier in operation.

In accordance with the concepts of this invention, there is provided a device for automatic adjustment of a roll gap in a mill stand, which is simple in construction, inexpensive to manufacture, and enables the use of a fluid (oil) with a purity degree characteristic of that employed in conventional hydraulic drives, said device being easy in operation and readily serviceable by attendants of ordinary skill.

Figure 2:
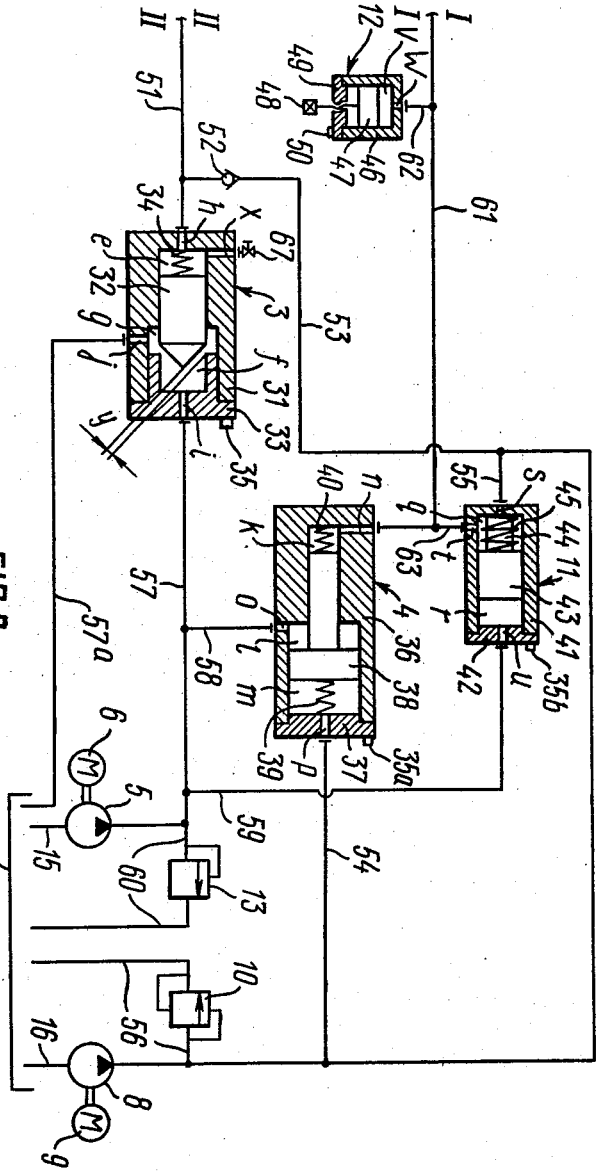
Figure 3:
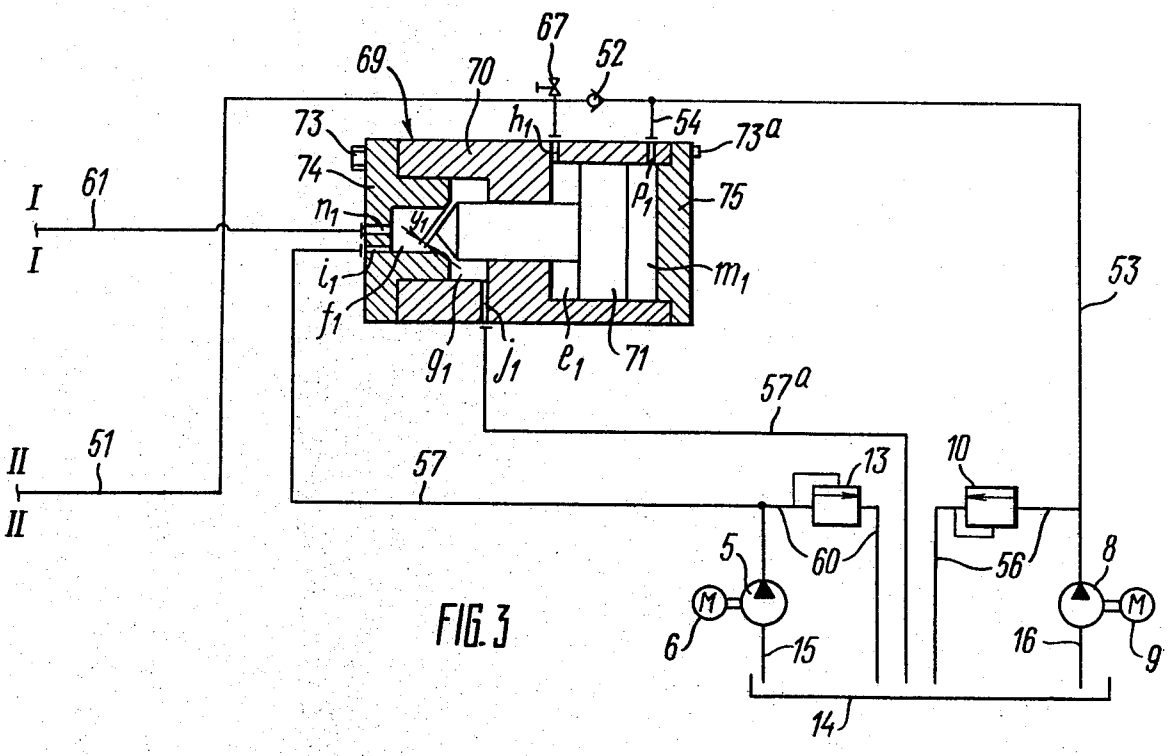

The invention will now be explained in greater detail with reference to embodiments thereof which are represented in the accompanying drawings, wherein:

FIG. 1 is an elevational view showing a roll mill stand with one part of a device for automatic adjustment of a roll gap, according to the invention, with a cross-sectional view of hydraulic cylinders and a load cell on one side of the mill stand;

FIG. 2 is a cross-sectional view of the units shown in the device shown in FIG. 1 and an illustration of the remaining part of the device for automatic adjustment of a roll gap in a mill stand, according to the invention; and FIG. 3 is a cross sectional view of a part of the device for automatic adjustment of a roll gap in a mill stand wherein a regulated pressure valve is combined with a three-chamber pressure regulator.

Referring now to FIGS. 1 and 2, there is illustrated therein a device for automatic adjustment of a roll gap in a mill stand, said device, if viewed from one side of a mill stand 1, being symmetrically arranged on both sides of the mill stand.

Each part of said device comprises a load cell 2 adapted to absorb a rolling force "P" and connected through fluid pressure lines with a regulated pressure valve 3 which is operated to vary, in accordance with a rolling force, the pressure and flow rate of oil (fluid) fed into a three-chamber pressure regulator 4 by means of a pump 5 actuated by an electric drive 6.

Hydraulic cylinders 7 are intended for prestressing a mill stand and are connected with the three-chamber pressure regulator 4, which is adapted to vary the oil pressure in the hydraulic cylinders in accordance with a pressure level in a pump 8 actuated by an electric drive 9 and in the pump 5 actuated by the electric drive 6.

The pump 5 with the electric drive 6 and the pump 8 with the electric drive 9 are arranged or located outside the mill stand.

The oil pressure established by the pump 8 is maintained constant by means of a pressure control valve 10, while the oil pressure established by the pump 5 is regulated by the pressure valve 3 according to the oil pressure in the load cell 2.

The device of the invention is also provided with a shutoff valve 11 placing in communication chambers of the hydraulic cylinders 7 with a first end chamber of the pressure regulator 4 with the pump 8.

To vary the amount of oil in the aforesaid chambers, there is provided a means 12.

The proposed device is also provided with a safety valve 13 fitted in the delivery line of the pump 5, a receiver 14 for a fluid (oil) and pressure fluid lines 15 and 16 connecting the pumps 5 and 8, respectively, with the fluid receiver 14.

The load cells 2 comprises a shell 17 accommodating in its bore, in the interspace between a cover 18, fixed by screws 18*a* to the shell 17, and a rigid bottom 19, a piston 20 forming, together with the rigid bottom 19 of the shell, a chamber "*a*" of the load cell. The shell 17 is formed with a channel "*b*" for delivery of oil into or out of the chamber "*a*". The shell 17 with its supporting portion interacts with a rocker plate 21 of a roll housing 22, and a piston rod 23 interacts with a chock 24 of a bottom backup roll 25.

The load cell 2 may comprise a plurality of interconnected chambers each formed by a piston and a shell of a given hydraulic cylinder. This being the case, the volume of the load cell chamber "*a*" and the piston area F*a* in said load cell will be equal to the sum total of said volume and said area formed by the hydraulic cylinders making up the load cell.

Each hydraulic cylinder 7 comprises a shell 26 accommodating in the bore thereof a plunger 27 forming together with said shell a chamber "*c*". The shell 27 is formed with a channel "*d*" for delivery of oil therealong into or out of the chamber "*c*". The shells 26 are arranged in a chock 28 of a top backup roll 29 and interact therewith by their supporting surfaces, while the plungers 27 interact with a recess portion 30 of the roll housing 22.

The regulated pressure valve 3, adapted to regulate the pressure and flow rate of oil pumped up by the pump 5, comprises a shell 31 accommodating in its bore a valve spool 32 whose tapered portion is pressed against a cover 33 by a spring 34 thrust up against the bottom of the bore of the shell 31. The cover 33 is fixed to the shell 31 by screws 35. The valve spool 32 together with the shell 31 forms a control chamber "*e*", together with the cover forms a throttle chamber "*f*", and in combination with the shell 31 and the cover 33 forms a fluid outlet chamber "*g*". Each said chamber is provided with one channel "*h*", "*i*" and "*j*", respectively, for delivery therealong of in-and-out moving fluid.

The three-chamber pressure regulator 4 comprises a shell 36, a cover 37 screwed on by screws 35*a*, and a stepped spool 38 accommodated in the bore of the shell 36 and forming therewith three chambers: a first end chamber "*k*", a midchamber "*l*" and a second end chamber "*m*". Each said chamber is provided with one channel "*n*", "*o*" and "*p*", respectively, for delivery therealong of in-and-out moving oil. The spool 38 is spring-loaded at the side of the cover 37 by a spring 39 and at the side of the shell by a spring 40.

The shut-off valve 11 comprises a shell 41, a cover 42 fixed to said shell by screws 35*b*, and a valve spool 43 spring-loaded at the side of a pintle 44 by a spring 45. The spool 43 together with the shell forms a chamber "*q*", and together with the shell and the cover it forms a chamber "*r*". The shell 41 is formed with channels "*s*" and "*t*" for delivery of oil therealong into or out of the chamber "*q*", and with a channel "*u*" for delivery of oil therealong into the chamber "*r*".

The means 12 for varying an amount of oil in the closed chamber, formed with the chamber "*c*" of the hydraulic cylinders 7 together with the first end chamber "*k*" of the pressure regulator 4, is made as a cylinder comprising a shell 46 accommodating in its bore a piston 47 with a screw rod 48 screwed into a cover 49 fixed to the shell 46 by screws 50. The piston 47 and the shell 46 form a working chamber "*v*" of the hydraulic cylinder. The shell 46 is formed with a channel "*w*" for delivery of oil therealong into or out of the chamber "*v*".

The chamber "*a*" of the load cell 2 is connected by a pressure fluid line 51 to the control chamber "*e*" of the regulated pressure valve 3. In order to have the chambers "*a*" and "*e*" filled with oil, there is connected to the line 51 through a non-return valve 52 a line 53 along which oil is delivered into said chambers under constant pressure by the pump 8.

The fluid pressure line 53 also has connected thereto a line 54 in communication with the second end chamber "*m*" of the pressure regulator 4, a line 55 connected through the channel "*s*" with the chamber "*q*" of the shutoff valve 11 and a line 56 connected through the pressure control valve 10 with the fluid receiver 14.

The throttle chamber "*f*" of the regulated pressure valve 3 is connected simultaneously with the pump 5 by means of a line 57, with the midchamber "*l*" of the pressure regulator 4 by means of a line 58 connected to the line 57, with the chamber "*r*" of the shut-off valve 11 by means of a line 59 connected to the line 57, and with the receiver 14 through the safety valve 13 and a line 60 connected to the line 57.

The chambers "*c*" of the hydraulic cylinders 7 are interconnected with each other as well as with the first end chamber "*k*" of the pressure regulator 4 by a line 61, with the working chamber "*v*" of the means (hydraulic cylinder) 12 by a line 62 connected to the line 61, and with the channel "*t*" of the shutoff valve 11 by a line 63 connected to the line 61.

The herein proposed device operates in the following manner.

Prior to advancing a metal strip between the rolls of the mill stand 11 by operating a screw-down gear 64, a roll gap "*h*" is adjusted between a top working roll 65 and a bottom working roll 66. The electric drive 9 of the pump 8 and the electric drive 6 of the pump 5 are energized.

A flow of oil, (fluid) passing by gravity into the pump 8 along the line 16 from the receiver 14, is then pumped up along the line 53. Therefrom the oil flows through the non-return valve 52 and the line 51 into the chamber "*a*" of the load cell 2 into the chamber "*e*" of the pressure valve 3. The oil also flows through the lines 55, 63 and 61 through the channels "*s*" and "*t*" into the chamber "*q*" of the shutoff valve 11 into the chambers "*c*" of the hydraulic cylinders 7, into the chamber "*v*" of the means (hydraulic cylinder) 12 and into the first end chamber "*k*" of the three-chamber pressure regulator 4. Oil also flows along the line 54 through the channel "*p*" into the second end chamber "*m*" of the three-chamber pressure regulator 4. As this happens, the air, or a mixture of air and oil from said chambers and lines, can be readily let out or poured out of the chamber "*e*" of the pressure control valve 3 through a channel "*x*" when a valve 67 is opened, and from the line 61 along lines (not shown) into the receiver 14 by opening a valve 68.

Excess oil from the pump 8, left over after filling all said chambers and lines (valves 67 and 68 are closed), is poured out into the receiver 14 along the line 56 through the pressure control valve 10 adapted to maintain a prescribed constant oil pressure ($q_o$=const) during operation of the pump 8.

The oil pressure level $q_o$ along the delivery line of the pump 8 varies with the mill stand prestressing force.

The pump 5 pumps the oil flowing thereinto by gravity from the receiver 14 along the line 15, said oil flowing at the same time into the throttle chamber "*f*" of the regulated pressure valve 3 along the line 57, into the mid-chamber "*l*" of the pressure regulator 4 along the lines 57 and 58, and into the chamber "*r*" of the shutoff valve 11 along the lines 57 and 59.

Excess oil from the pump 5 flows from the throttle chamber "*f*" through a slit "*y*", formed by the valve spool 32 and the cover 33, into the oil outlet chamber "*g*" and therefrom through the channel "*j*" along the line 57*a* into the receiver 14.

The pressure of the pump 5 along the delivery line is equal to that of the pump 8. This equality stems from the condition of equilibrity of the valve spool 32 of the regulated pressure valve 3.

Therefore, all chambers of the device units and fluid pressure lines are filled with oil under pressure equal to "$q_o$".

As a result of this pressure, a part of the roll housing 22 of the mill stand 1 with the screw-down gear 64 and the chock 28 of the top backup roll 29 is prestressed by a force "Q", developed by the oil pressure "$q_o$" in the chambers "*c*" of the hydraulic cylinders 7, and is deformed under the action of said force to a size "*Oh*".

Therewith, the chock 24 of the bottom backup roll 25, bearing up against the piston 20 of the load cell 2, is fixed in position, since said piston 20 is in a condition of equilibrium under the action of forces evolved by pressure "$q_o$" in the chamber "*a*" on one side, and by weight of the chocks with rolls 25 and 66 (taking into account the thrust force of the chocks of the working rolls) and by the bearing pressure of the cover 18 and the shell 17 on the other.

The valve spool 43 of the shutoff valve 11 is also in a condition of equilibrium. When the oil pressure in the chambers "*q*" and "*r*" is equal, the valve spool 43 is in its extreme right-hand position is pressed against the cover 42 by the spring 45. The channels "*s*" and "*t*" of the shutoff valve 11 are in communication through the chamber "*q*", which results in the chambers "*c*" of the hydraulic cylinders 7 and the first end chamber "*k*" being in communication with the pump 8.

The valve spool 38 of the pressure regulator 4 is in a condition of equilibrium in its extreme right-hand position under the action of forces built up by the oil pressure "$q_o$" in the first "*k*" and second "*m*" end chambers and in the midchamber "*l*", and also under the action of the springs 39 and 40.

The gap between the working rolls 65 and 66, before a strip is fed therebetween, equals the sum total of the gap "*h*" of the unloaded rolls and the deformation "*Oh*" of the prestressed part of the roll housing.

When the metal strip is advanced between the working rolls 65 and 66 of the roll mill stand 1, there originates a rolling pressure force "P" acting upon the stand elements, and through the backup roll 25 and the chock 24 upon the load cell 2. As this happens, the mill stand expands to a size "*Oh*", thereby increasing the gap between the rolls to a larger size as compared to that prior to the device operation.

The adjustment of the gap between the working rolls 65 and 66 commences under the action of the rolling pressure force "P" on the load cell 2, the magnitude of said pressure force being slightly in excess of that indicated by the bearing pressure of the cover 18 acting on the piston 20 of the load cell 2. Further increase in the rolling pressure force results in the increase of the oil pressure in the chamber "*a*" of the load cell 2. The oil pressure is likewise built up in the line 51 and the control chamber "*e*" of the regulated pressure valve 3. As a result of this, the non-return valve 52 is closed thereby forming a closed chamber with the chamber "*a*" of the load cell 2 and the chamber "*e*" of the regulated pressure valve 3, wherein the oil pressure is proportional to the rolling pressure force "P" and the magnitude thereof exceeds $q_o$.

The oil pressure increase in said closed chamber upsets the equilibrium of the valve spool 32 thereby, shifting it towards the cover 33 thus reducing the size of the slit "*y*" between the spool 32 and the cover 33. This in turn will decrease the amount of oil flowing from the throttle chamber "*f*" through the slit "*y*" into the discharge chamber "*g*", and will increase the output pressure of the pump 5.

The increased output pressure of the pump 5 will cause simultaneous displacement of the spool 43 of the shutoff valve 11 and of the spool 38 of the pressure regulator 4. The spool 43 of the shutoff valve 11 will be shifted in the left-hand direction having its pintle 44 thrust up against the bottom of the shell 41.

This will be made possible only after the pressure force, built up by the pressure of the pump 5 in the chamber "*r*", exceeds that produced by the pressure "$q_o$" in the chamber "*q*" and by the spring 45. The valve spool 43 will cut off the channel "*s*" from the chamber "*q*". This will result in a closed chamber formed by the chamber "*c*" of the hydraulic cylinders 7 and the chamber "*k*" of the pressure regulator 4, wherein the pressure of the oil, its amount being invariable, is proportional to the shifting range of the spool 38 of the three-chamber pressure regulator 4 and of the plungers 27 of the hydraulic cylinders 7.

During rolling operations the roll gap is varied with the rolling pressure force "P" which causes deflection of the mill stand. In order to maintain the roll gap constant, it is necessary that the mill stand deflection be in no way affected by variations in the rolling force "P". This function is performed by the herein disclosed device as soon as the closed chamber is formed by the chamber "*c*" of the hydraulic cylinders 7 and the first end chamber "*k*" of the pressure regulator 4. The proposed device functions in such a manner that the increment "O$h_1$" of the mill stand deflection ensuing from the change of the rolling force to a value "OP" is compensated for by the increment "O*h*" of the deflection of a part of the roll housing ensuing from the increment "OQ" of the mill stand prestressing force, and is expressed by the equation:

$$\frac{OP}{K_1} - \frac{OQ}{K} = 0 \qquad \text{(I)}$$

where $OP = Oh_1$ is the deflection of the mill stand $K_1$ $K_1$ is the rigidity factor of the mill stand, which depends upon its configuration;

$OQ = Oh$ is the deflection of a part of the $K$ stand mill with a decrease in force Q;

$K$ is the rigidity factor of a part of the mill stand under force Q, which also depends upon its configuration.

From the equation (1) it follows that the ratio of factors "K" and "$K_1$" should be equal to the ratio of values OQ and OP, viz., $$\frac{OQ}{OP} = \frac{K}{K_1}$$

Thus, owing to the afore described operating conditions of the proposed device, and with the equation (I) fulfilled, the roll gap will remain constant notwithstanding a change in the rolling pressure force "P".

It is easy to see that a change (increase) in the rolling pressure force "P" to the value of OP will cause a change (increase) in the oil pressure in the closed chamber, formed by the chamber "$a$" of the load cell and the control chamber "$e$" of the regulated pressure valve 3, to the value:

$$Oq = \frac{OP}{2Fa} \tag{3}$$

where $Fa$ is the area of the piston 20 in the chamber "$a$" of the load cell 2.

This will cause, as has been stated above when discussing the equilibrium of the spool 32 of the regulated pressure valve 3, a change (increase) from the value of $Oq_1$ of the pressure of the pump 5 to the value equal to $O_q$, viz., $$Oq_1 = Oq = \frac{OP}{2F_a} \tag{3a}$$

In this case the valve spool 38 of the three-chamber pressure regulator 4 will shift towards the cover 37 thereby increasing the closed chamber comprising the chamber "$c$" of the hydraulic cylinders 7 and the first end chamber "$k$" of the pressure regulator 4, which will cause a change (decrease) in pressure in said closed chamber.

The value $Oq_2$ of this change (decrease) can be determined from the equilibrium condition of the spool 38 of the three-chamber pressure regulator 4, which is expressed as follows:

$$q_o \cdot Fm - q_1Fl - q_2F_k = 0 \tag{4}$$

where $q_1 = q_o + Oq_1$ $q_2 = q_o - Oq_2$

At $F_m - Fl - Fk = 0$, where $Fm$, $Fl$ and $Fk$ are the areas of the chambers "$m$", "$l$" and "$k$", respectively, the equation (4) is reduced to the form:

$$- Oq_1 \cdot Fl + Oq_2Fk = 0 \tag{5}$$

From the equation (5) we find the dependence between the change in the oil pressure in said closed chamber and the change of pressure of the pump 5.

$$Oq_2 = Oq_1 \cdot \frac{Fl}{Fk} \tag{6}$$

Substituting the expression (3$a$) into the equation (6), we find the value of the oil pressure change in the closed chamber, depending on the increment $OP$, $$Oq_2 = \frac{OP}{2Fa} \cdot \frac{Fl}{Fk} \tag{7}$$

The change (decrease) in the mill stand prestressing force will be determined from the equation, $$OQ = Oq_2 \cdot Fc \tag{8}$$

where $Fc$ is the area of the plungers 27 of the hydraulic cylinders 7.

Substituting the expression (8) into the equation (7), we find the dependence between $OQ$ and $OP$:

$$\frac{OQ}{OP} = \frac{Fl \cdot Fc}{2Fa \cdot Fk} \tag{9}$$

It is seen from the equations (2) and (9) that their left-hand parts are equal, therefore, simultaneous solutions of these equations will give $$\frac{K}{K_1} = \frac{Fl \cdot Fc}{2Fa \cdot Fk} \tag{10}$$

Equation (10) is a necessary condition for the equation (1) to be fulfilled, so as to have the roll gap adjusted by the herein-described device constant.

Initial values used for selecting the device parameters are the following: the rigidity factor K denoting the rigidity of the roll housing loaded by force Q, the rigidity factor $K_1$ denoting the rigidity of the mill stand the rigidity factor $K_2$, denoting the rigidity of the mill stand section not loaded by the force Q, and the factor $K_3$ of proportion between the value of "OS" of displacement of the spool 38 of the three-chamber pressure regulator 4 and the value of OP of the change in the rolling force P.

According to the equation (7) there exists a linear dependence between the value $Oq_2$ of the oil pressure change in the closed chamber, formed by the chamber "$c$" of the hydraulic cylinders 7 and the first end chamber "$k$" of the pressure regulator 4, and the value $OP$ of the change in the rolling force "P". However, insofar as the value $Oq_2$ of the oil pressure change in said closed chamber is proportional to the displacement δS of the spool 38 of the three-chamber pressure regulator 4, there also exists a linear dependence between $OS$ and $OP$ with the proportion factor $K_3$:

$$K_3 = \frac{OP}{OS} \tag{11}$$

Let us then determine the parameters of the closed chamber, formed by the chamber "$c$" of the hydraulic cylinders 7 and the first end chamber "$k$" of the pressure regulator 4, for particularly specified values of K, $K_1$, $K_2$ and $K_3$.

Next, the dependence is found between the change in the oil pressure $Oq_2$ in said closed chamber $W_1$ and the increment $OW_1$ of this closed chamber, the amount of oil therein being constant. Having an oil compression factor of "B" (inverse of the modulus of rigidity), the value of the pressure change will be equal to $$Oq_2 = \frac{OW_1}{B \cdot W_1} \quad (12)$$

Substituting the expression (12) into the equation (8), we find the value $OQ$ of the change in the prestressing force Q $$OQ = \frac{OW_1 \cdot Fc}{B \cdot W_1} \quad (13)$$

According to the equation (1), the change OQ of the force Q corresponds to the equation $$OQ = OP \frac{K}{K_1} \quad (14)$$

Simultaneous solution of the equations (13) and (14) gives the dependence between the quantity $W_1$ of oil in the closed chamber and the increment $OW_1$ $$W_1 = \frac{K_1}{K} \cdot \frac{OW_1}{OP} \cdot \frac{Fc}{B} \quad (15)$$

The increment $OW_1$ of the closed chamber $W_1$, ensuing from the change in the rolling force, is caused by two factors.

On the one hand, it is caused by the displacement $\delta S_1$ of the plungers 27 with respect to the shells 26 of the hydraulic cylinders 7 at the time when the chocks 28 and 24 of the top backup roll 29 and the bottom backup roll 25 are brought closed together to the value $\delta h_2$ of flexural deflection of elements of the mill stand 1 (working rolls 65 and 66, backup rolls 29 and 25, chock 24 of the bottom backup roll 25, load cell 2 and bottom part of the roll housing) not loaded by the force Q. With an increase in the rolling force, the herein described device operates to bring closer and closer together the chocks 24 and 28, whereby the aforesaid closed chamber acquires a negative increment through the displacement of the plungers 27.

On the other hand, it is caused by the displacement $\delta S$ of the spool 38 of the three-chamber pressure regulator 4. In this case, an increase in the rolling force brings about a positive increment to the closed chamber $W_1$.

Therefore, the value $OW_1$ of the increment of the closed chamber will be expressed as follows:

$$OW_1 = OS \cdot Fk - Oh_2 Fc \quad (16)$$

Substituting the expression (16) into the equation (15), we find the dependence between the amount of oil in the closed chamber and the specified parameters: $K$, $K_1$, $K_2$ and $K_3$:

$$W_1 = \frac{K_1}{K} \frac{Fc}{B} \left( \frac{OS \cdot Fk}{OP} - \frac{Oh_2 Fc}{OP} \right) \quad (17)$$

Taking into account that, $$\frac{OS}{OP} = \frac{1}{K_3}, \frac{Oh_2}{OP} = \frac{1}{K_2}$$

the equation (17) is reduced to $$N_1 = \frac{K_1 \cdot F^2 c}{K B} \left( \frac{1}{K_3} \cdot \frac{Fk}{Fc} - \frac{1}{K2} \right) \quad (18)$$

The equation (18) is the principal condition for selecting the volume of the closed chamber formed by the chamber "*c*" of the hydraulic cylinders 7 and the first end chamber "*k*" of the pressure regulator 4.

The volume of said closed chamber is found analytically, having the specified values of K, $K_1$, $K_2$, $K_3$, $F_c$, $F_k$ and $\beta$.

In practice, however, these values may differ from the calculated ones. Therefore, the requisite value $W_1$ of said closed chamber is preset and where necessary adjusted with the aid of means (hydraulic cylinder) 12 through displacement of the piston 47 pushed by the screw rod 48 relative to the shell 46.

To prevent the rolling mill stand 1 and the device of the invention from overloads, the safety valve 13 of the pump 5 is set to the pressure corresponding to the peak value of the rolling force.

When the metal sheet or strip issues from the mill stand, the oil pressure in the closed chamber, chamber "*a*" of the load cell 2 and control chamber "*e*" of the regulated pressure valve 3, will decrease and when its value is less than $q_o$, said closed chamber will be brought into communication with the pump 8.

As a result, the pressure in the closed chamber will equal $q_o$. Consequently, the pressure built up by the pump 5 will also equal $q_o$ and this will cause the valve spool 43 of the shutoff valve 11 to shift towards, and be thrust up against the cover 42. Therewith, the chambers "*c*" of the hydraulic cylinders 7, the chamber "*v*" of the means 12 and the first end chamber "*k*" will be brought into communication through the channels "*s, t*" and the chamber "*q*" of the shutoff valve 11 with the pump 8.

Thus, all the chambers of the herein disclosed device and fluid pressure lines will be refilled with oil under pressure "$q_o$", said device being ready to resume its operating cycle of the roll gap adjustment.

The embodiment of the device for the automatic adjustment of the roll gap in a mill stand shown in FIGS. 1 and 3 differs from that shown in FIGS. 1 and 2 in that it features integral operation of the three-chamber pressure regulator 4 and the regulated pressure valve 3, these units being made integral to form a new unit, the regulated valve-pressure regulator 69.

Further, the integral operation of said units makes it possible to dispense with such units as the means 12, the shutoff valve 11 and the pressure fluid lines 55, 58, 59, 62 and 63.

The remaining units of the device of the invention, such as the load cell 2, the hydraulic cylinders 7, the pump 5 with the electric drive 6, the pump 8 with the electric drive 9, the pressure control valve 10, the safety valve 13, the receiver 14 and the lines 51, 53, 54, 57*a*, 61, as well as the non-return the valve 57 and valves 67 and 68, perform functions similar to those described in the first embodiment and have the same reference numerals.

As to the newly formed unit, the regulated valve-pressure regulator 69, it should be said that the remaining chambers and channels formed therein after combining the three-chamber pressure regulator with the regulated valve perform functions similar to those described in the first embodiment and have the same reference symbols accompanied by figure notation.

The regulated valve-pressure regulator 69 comprises a shell 70 accommodating in its bore a two-stepped valve spool 71 tapered at the smaller-diameter end thereof. Fixed to the shell 70 by screws 73 and 73a at the side of the spool tapered end is a cover 74 at the side of the spool bigger-diameter portion is a cover 75.

The valve spool 71 forms together with the cover 74 a throttle chamber "$f_1$", together with the shell 70 and the cover 74 a discharge chamber "$g_1$", together with the shell 70 a control chamber "$e_1$", and finally with the cover 75 and the shell 70 it forms a second end chamber "$m_1$".

For delivery of oil into or out of said chambers, the cover 74 and the body of the shell 70 are formed with channels $h_1$, $i_1$, $j_1$, $h_1$ and $p_1$, respectively. The throttle chamber $f_1$ of the regulated valve-pressure regulator 69 communicates, just as in the first embodiment, with an alternating-pressure pump 5 through the channel $i_1$ and a fluid pressure line 57. In addition, the throttle chamber communicates through the channel $n_1$ and the line 61 with a chamber "*c*" of the hydraulic cylinders 7. The discharge chamber $g_1$ communicates through the channel $j_1$ and a line 57a with a receiver 14. The control chamber $e_1$ communicates through the channel $h_1$ and a line 51 with a chamber "*a*" of a load cell 2, the line 51 communicating through a non-return valve 52 and a line 53 with a constant-pressure pump 8.

The second embodiment of the proposed device functions in the following manner.

The electric drives 9 and 6 are energized to actuate the respective pumps 8 and 5 operating to fill up all of said unit chambers of the device with oil. The oil under pressure $q_o$ pumped by the pump 8 fills, flowing through the lines 53 and 54, the second end chamber $m_1$ of the regulated valve-pressure regulator 69, and flowing through the line 53, the non-return valve 52 and the line 51, the oil under pressure fills the chamber "*a*" of the load cell 2 and the control chamber $e_1$ of the regulated valve-pressure regulator 69.

The air is released from all chambers and lines by opening the valve 67 through a line (not shown) into the receiver 14.

The chambers "*c*" of the hydraulic cylinders and the throttle chamber $f_1$ of the regulated valve-pressure regulator 69 are filled with oil flowing along the lines 57 and 61 and pumped up by the pump 5. Excess oil flows over from the throttle chamber $f_1$ through a slit $y_1$, formed by the spool 71 and the cover 74, into the discharge chamber $g_1$ and further on through the channel $j_1$ along the line 57a into the receiver 14. As this happens, the pressure built up by the pump 5 equals $q_o$. This equality proceeds from the equilibrium condition of the spool 71 of the regulated valve-pressure regulator 69, if the equation $$Ff_1 + Fe_1 - Fm_1 = 0 \qquad (19),$$

where $Ff_1$, $Fe_1$ and $Fm_1$, are the areas of the spool 71 in the chambers $f_1$, $e_1$ and $m_1$, respectively is fulfilled.

Thus, all the unit chambers of the described device are under the pressure of $q_o$, which results in the mill being prestressed by the force Q.

The device is brought into operation as the metal sheet or strip is fed into the mill. The switching-on moment corresponds to the rolling force when its value exceeds that of the reaction at the cover 18, acting on the piston of the load cell 2.

Further increase in the rolling force P will cause an increase in the oil pressure in the chamber "*a*" of the load cell 2, and consequently, in the line 51 and the control chamber $e_1$ of the regulated valve-pressure regulator 69.

Therewith, the non-return valve will cut off said chambers from the pump 8 thereby resulting in a closed chamber being formed by the chamber "*a*" of the load cell 2 and the control chamber $e_1$ of the regulated valve-pressure regulator 69. The increasing pressure in the closed chamber will offset the equilibrium of the spool 71 of the regulated valve-pressure regulator 69 thereby causing its displacement. This in turn will increase the slit $y_1$ between the spool 71 and the cover 74.

From this will follow a decreased resistance to a flow of oil pumped by the pump 5, passing from the throttle chamber through the slit $y_1$ into the discharge chamber $g_1$, and, hence, lower pressure in the pump 5 as well as in the chambers "*c*" of the hydraulic cylinders 7 adapted to effect prestressing of the mill stand.

As a result of this, an increase in the rolling force P will cause a decrease in the mill prestressing force Q. And conversely, if the rolling force P is decreased, the mill prestressing force Q will be increased.

Applying the method of calculation similar to that used for selecting a parameters for the first embodiment of the invention, one can find the parameters $Fe_1$, $Fe$, $Fa$, $Ff_1$ and their relationships for the given device at specified values of $K$ and $K_1$ according to the equation;

$$\frac{K}{K_1} = \frac{Fe_1 \cdot Fe}{2Fa \cdot Ff\,1} \qquad (20)$$

This condition being fulfilled, the increment ensuing from the mill stand deflection will be compensated for by the increment ensuing from the deflection of a mill stand section caused by the change in the mill stand prestressing force, i.e. the condition, represented by the equation (1), $$\frac{OP}{K} - \frac{OQ}{K_1} = O \qquad (1)$$

will be fulfilled, said equation holding true for the given embodiment of the invention.

If the equation (1) is fulfilled, the gap between the working rolls will remain unchanged, just as in the case of the first embodiment of the invention, and the change in the rolling force and the ensuing deflection of the mill stand will in no way affect the roll-gap profile.

What is claimed is:

1. A device for automatic adjustment of a roll gap between working rolls in a mill stand, comprising two similar parts operating on an identical principle, one of said parts being arranged on each side of the mill stand, said operable parts comprising: at least one one-chamber load cell, mounted under a backup member of one of said working rolls, to absorb a rolling force, said load cell having a piston rod; hydraulic cylinders mounted intermediate of a backup member of another working roll and a roll housing so as to have no effect on said load cell, said cylinders prestressing said mill stand; a three-chamber fluid pressure regulator mounted on said mill stand and having two end chambers and a midchamber, said pressure regulator communicating through a first end chamber with chambers of the hydraulic cylinders and through said midchamber with the chamber of said load cell, said pressure regulator changing the fluid pressure in said hydraulic cylinders for prestressing the mill stand; a regulated pressure valve mounted on the shell of said load cell and having a throttle chamber and a control chamber, said control chamber communicating with said chamber of said load cell, said regulated pressure valve having a spool with a diameter less than the diameter of said piston rod of said load cell; a variable-pressure fluid source arranged outside said mill stand and communicating with the throttle chamber of said regulated pressure valve to maintain therein a variable fluid pressure proportional to said rolling force; and constant-pressure fluid sources, at least one for each operable part of said device arranged on each side of said mill stand and externally thereof, said source communicating with chambers of said hydraulic cylinders and said load cell and a second end chamber of said three-chamber pressure regulator, the fluid being delivered from said constant-pressure fluid source to fill up said chambers and to build up constant pressure therein; the rolling force, originating during the rolling operation, causes fluid to pass from said load cell into the control chamber of said regulated pressure valve, the traverse of said spool being limited to prevent the fluid from overflowing from said load cell into the midchamber of said three-chamber pressure regulator which would render immobile the roll chock resting against said piston of said load cell.

2. A device as claimed in claim 1, wherein said regulated pressure valve and said three-chamber pressure regulator are combined to form a regulated valve-pressure regulator, the midchamber of said three-chamber pressure regulator serving as the control chamber of said regulated pressure valve, and the first end chamber of said pressure regulator serving as the throttle chamber of said regulated pressure valve; as a result of said combined arrangement the fluid is fed, during a rolling operation, to said hydraulic cylinders for prestressing the mill stand directly from said constant-pressure fluid source.

3. A device as claimed in claim 1, wherein each operable part further comprises a varying means for each of said load cells arranged on said mill stand for varying an amount of fluid in a closed chamber defined during the rolling operation by chambers of said hydraulic cylinders and the first end chamber of said pressure regulator, said varying means being made as a hydraulic cylinder with a screw rod, a working chamber of said varying means being in communication with the closed chamber.

* * * * *